US006334288B1

(12) United States Patent
Amaranti et al.

(10) Patent No.: US 6,334,288 B1
(45) Date of Patent: Jan. 1, 2002

(54) APPARATUS FOR PRINTING, CUTTING, CROPPING OF BLISTER PACKS OBTAINED FROM A BLISTER BAND

(75) Inventors: Alessandro Amaranti, Castel S. Pietro Termo; Alessandro Alessandri, Funo di Argelato, both of (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 09/381,413

(22) PCT Filed: Mar. 13, 1998

(86) PCT No.: PCT/IB98/00348

§ 371 Date: Sep. 17, 1999

§ 102(e) Date: Sep. 17, 1999

(87) PCT Pub. No.: WO98/41451

PCT Pub. Date: Sep. 24, 1998

(30) Foreign Application Priority Data

Mar. 18, 1997 (IT) ..... BO97A0154

(51) Int. Cl.[7] ..... B65B 61/26; B21D 37/00

(52) U.S. Cl. ..... 53/131.2; 53/133.8; 53/249; 72/462; 72/482.2; 72/482.91

(58) Field of Search ..... 53/53, 54, 131.1, 53/131.2, 131.3, 133.3, 133.8, 249, 559, 561; 72/462, 482.1, 482.2, 482.9; 483/8, 9, 10, 11, 19, 28

(56) References Cited

U.S. PATENT DOCUMENTS

| | | | | | |
|---|---|---|---|---|---|
| 3,716,128 | A | * | 2/1973 | Edge et al. | 483/9 |
| 3,874,143 | A | * | 4/1975 | Braber | 53/133.8 |
| 3,945,230 | A | * | 3/1976 | Tomioka et al. | 483/10 |
| 4,012,888 | A | | 3/1977 | Nichols | |
| 4,142,398 | A | * | 3/1979 | Quaas | 72/482.2 |
| 4,160,372 | A | * | 7/1979 | Bergman et al. | 72/462 |
| 4,187,713 | A | * | 2/1980 | Fellner | 72/462 |
| 4,473,346 | A | * | 9/1984 | Hehl | 72/462 |
| 4,530,148 | A | * | 7/1985 | Flamme et al. | 483/9 |
| 5,378,218 | A | * | 1/1995 | Daimaru et al. | 483/9 |
| 5,443,436 | A | * | 8/1995 | Kawakami et al. | 483/9 |
| 5,619,913 | A | * | 4/1997 | Padovani | 483/28 |
| 5,755,653 | A | * | 5/1998 | Nishida | 483/28 |
| 6,070,385 | A | * | 6/2000 | Antonio | 53/53 |
| 6,109,000 | A | * | 8/2000 | Conti | 53/559 |
| 6,126,582 | A | * | 10/2000 | Dangelmayr et al. | 483/28 |

FOREIGN PATENT DOCUMENTS

| | | |
|---|---|---|
| DE | 4329 931 A1 | 3/1995 |
| EP | 0 248 700 A1 | 5/1987 |

* cited by examiner

*Primary Examiner*—Peter Vo
*Assistant Examiner*—Louis K. Huynh
(74) *Attorney, Agent, or Firm*—William J. Sapone; Coleman Sudol Sapone

(57) ABSTRACT

In an apparatus mounted on an automatic machine for packaging articles into blister packs, a working station (A) applies numeric codes to a blister band and a scoring station (B) equipped with scoring members (20), traces scoring lines on the blister band. In a cropping station (C) the blister packs are separated from the blister band, and in a disposal station (D), the remaining off-cuts are chopped. All these working stations are connected to a support body (1) and provided with plates (5,125) acted upon by pressers (53,54, 55) which are released by motorised releasing elements (60,80). The pressers and plates clamp each of the devices for numbering (10), cutting (20), and severing (30) the blister band. The releasing elements (60,80) act on the pressers to allow substitution and automatic adjustment, performed by an automatic adjustment system (110), of devices for numbering (10), cutting (20), and severing (30) the band in relation to the size of blister packs to be obtained. The plates (5,125) are carried by spacing bars **(6*a*,6*b*,6*c*,6*d*, 6*e*) fastened to the body (1) containing the releasing elements (60)**.

46 Claims, 9 Drawing Sheets

FIG. 13
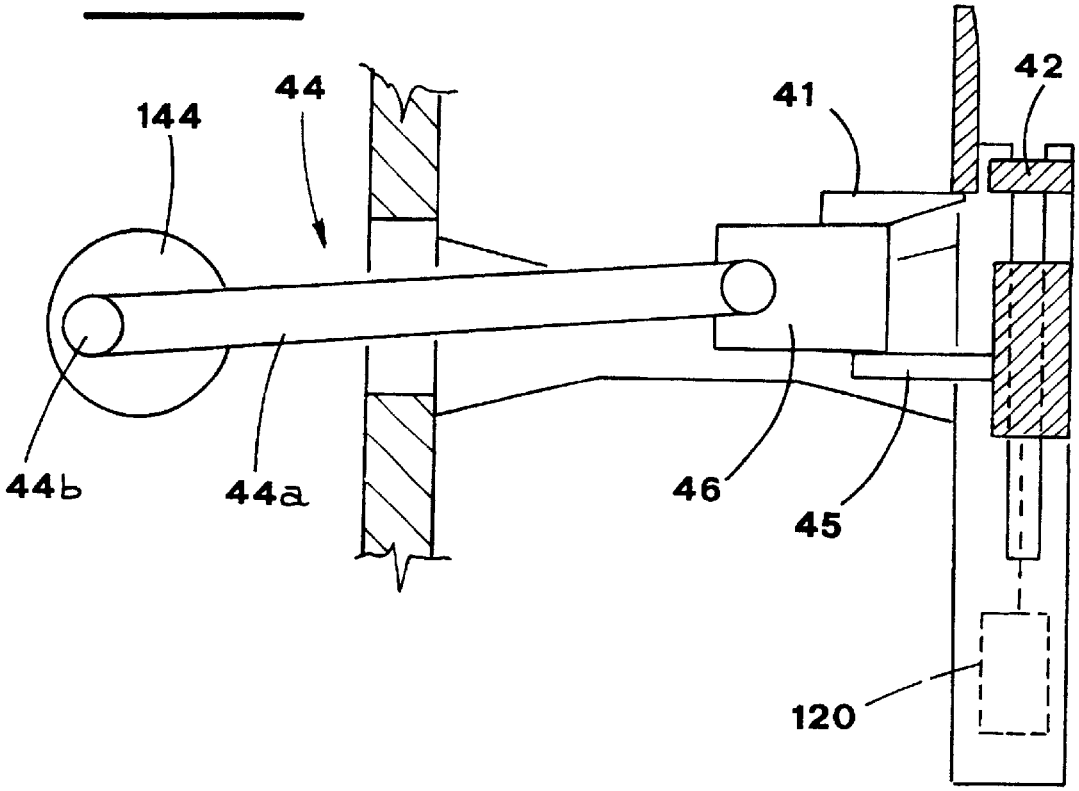
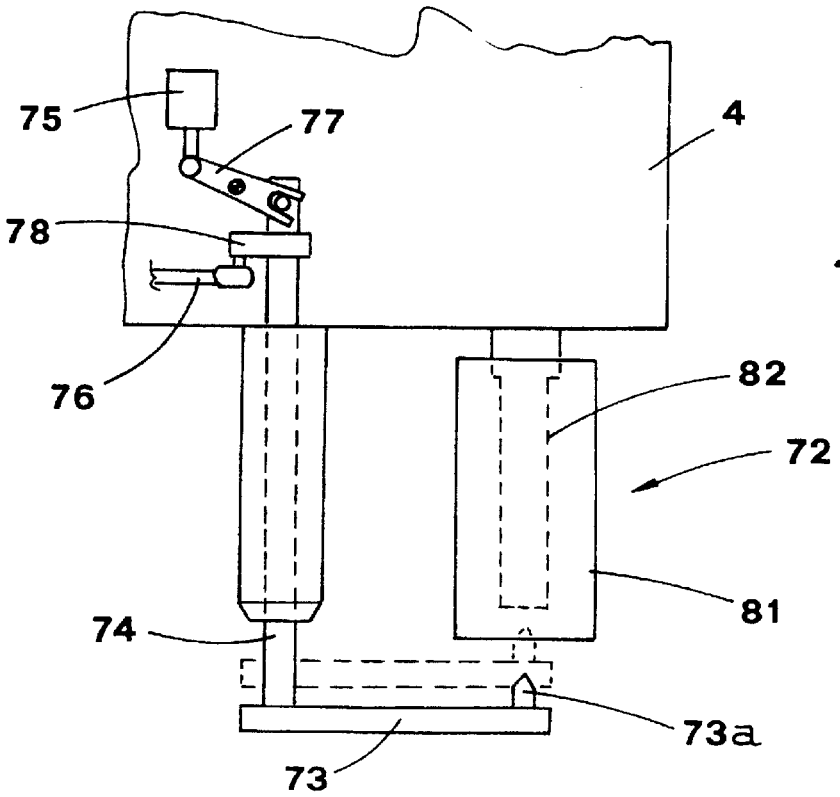
FIG. 14

APPARATUS FOR PRINTING, CUTTING, CROPPING OF BLISTER PACKS OBTAINED FROM A BLISTER BAND

BACKGROUND OF THE INVENTION

The present invention refers to the production of automatic machines for packaging various articles into portions of a blister band, commonly called blister packs.

In particular, the articles are medicines, such as tablets, capsules, pills and the like.

DESCRIPTION OF THE PRIOR ART

Machines are known for producing blisters on a band of thermoformable material and subsequently fill these blisters with articles.

After having been filled, the blister band is driven through a station for checking if the articles are in the blisters (this checking station can De equipped with means for detecting if the articles are not damaged), through a sealing station, where a film, of aluminium is applied to the upper face of the band featuring the open blisters, and through a severing station, where the sealed blister band is cut into separate blister packs.

Usually, there are other additional stations before the severing station, such as station where a numeric code containing the production date and lot is anplied.

Downstream of the severing station, there are means forming a stack of blisters to be introduced into a corresponding container.

There is also a station, where off-cuts remaining after the blister packs has been cropped, are broken into small pieces and gathered for subsequent recycling.

A shattering device is provided for chopping the off-cuts, so as to make them smaller and to facilitate the recycling operations.

The shattering device must operate in areas of the blister band which do not feature blisters, so as to avoid jams, which can occur when a part of the band to form a blister pack is not complete and therefore is not cropped, but passes directly to the off-cuts chopping station.

Therefore, it is necessary to adjust precisely the position of this shattering device with respect to the position of blisters on the band.

U.S. Pat. No. 4,012,888 discloses a blister-packaging machine wherein packaging material is treated at a succession of fluid-actuated stations arranged in-line and along which the packaging material is transported.

This machine includes treatment means at the respective stations and means for transporting the packaging material from station to station intermittently and wherein the respective treatment means are programmed to treat the packaging material at dwell time in such intermittent transporting.

The transporting means grips the packaging material continuously along its opposite edges at one of the treatment stations.

The stations include, in sequence blister-forming, filling, sealing, and perforating stations for the packaging material, and also transporting, printing, and cut-off stations for the packaging material.

The most important problem of this type of machines is connected with the size change over, i.e. adapting the working means to a different size of blisters to be produced, in time as short as possible.

It is also important to reduce the number of operators involved in the size change over operation, maintaining reduced times.

Known technical solutions require long slowing down of the working means fastened to the relative bodies joined to the machine support structure, substitution of these means, adjustment of the positions and finally, locking.

Therefore, possible alternatives are to assign more people to the substitution or provide longer periods of time before the production activity is resumed.

SUMMARY OF THE INVENTION

One object of the present invention is to provide an apparatus that allows size change over in extremely short time without involving more than one person and without constructive complications.

In the light of what above, another object of the invention is to provide an apparatus equipped with Locking systems operated by means controlled by a suitable control unit, thus allowing to automatically lock or unlock, selectively or globally, working means to be changed or adjusted.

According to further object of the invention, all the substitution operations must be performed in very short periods of time, which is possible due to the fact that the apparatus is arranged to unlock and lock working means by actuators which work practically instantaneously.

In short, according to the objects of the invention, the operator does not have to work for hours to release the means to be changed and to tighten them again after having adjusted their position.

According to still further object of the invention, the adjustment of the working means positions is performed by electronic means, thus making it possible to memorise and subsequently recall parameters of the means to be adjusted.

The above mentioned objects are obtained in accordance with the content of the claims, by means of an apparatus for printing, scoring, cropping blister packs obtained from a blister band, and for chopping remaining off-cuts, the apparatus being mounted on an automatic machine for packaging articles into blister packs, with said machine including:

- a station, in which a numeric code is applied to the blister band by a numbering devices operated by actuators, with first guide means for the blister band;
- a scoring station, equipped with scoring means operated by actuators, and with second guide means for the blister band;
- driving means for the blister band;
- a cropping station, equipped with severing means operated by actuators, with third guide means for the blister band, and with an oscillating arm provided with picking up means for picking up the completed blister packs and sending them to a packaging device;
- a station, in which remaining off-cuts of the blister band are chopped; and
- a base body for supporting all said means of the above mentioned stations.

The claimed apparatus is characterised in that said stations are equipped with clamping means for each said numbering devices, scoring members, severing means, and with motorised releasing elements acting on said clamping means as to release said numbering device, cutting members and severing means and to allow the substitution and automatic adjustment thereof by adjustment means in relation to the size of blister packs to be obtained.

BRIEF DESCRIPTION OF THE DRAWINGS

The characteristics of the invention will be pointed out in the following, with particular reference to the enclosed drawings, in which:

FIGS. 12 and 13 show further particulars of the additional station of the FIG. 11;

FIG. 14 shows a schematic view of an additional device of the subject apparatus;

PREFERRED MODE OF CARRYING OUT THE INVENTION

With reference to the enclosed figures, the subject apparatus to be mounted on an automatic machine for packaging articles into blister packs, is aimed at printing, scoring, cropping of blister packs 3 obtainer from the blister band 2 and, subsequently, chopping the remaining off-cuts.

Figure 1:
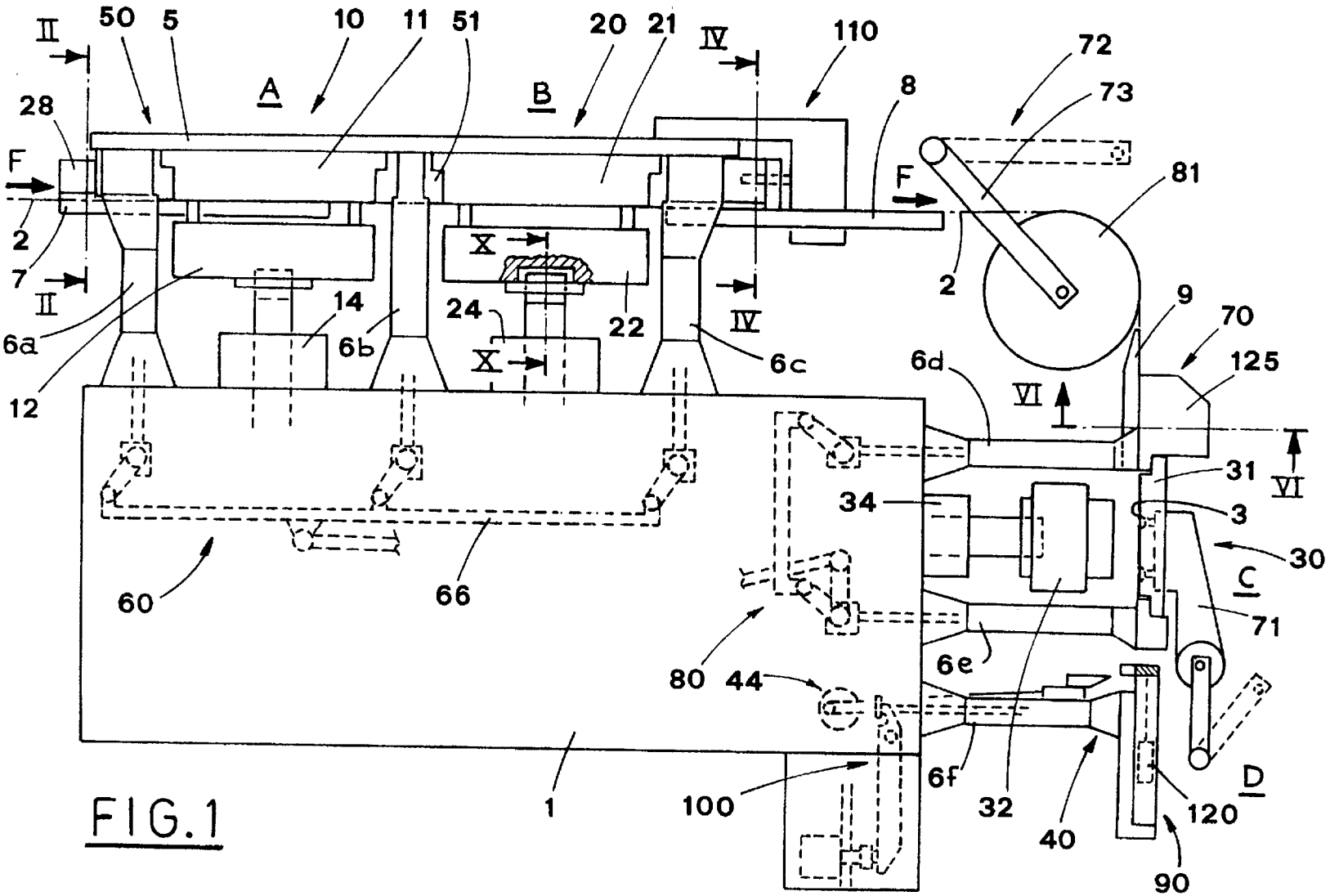
FIG. 1 shows a schematic lateral view of the apparatus being the subject of the present invention.

This apparatus, as seen in FIG. 1, is provided with a series of stations mounted on a support base body 1. In a first working station A, a numeric code is applied to the band. The numeric code applying station is equipped with numbering devices 20. A subsequent scoring station B is equipped with scoring members 20, and a cropping station C is equipped with severing means 30. Finally, a station D is provided for shattering the remaining off-cuts of the band.

According to the embodiment described and illustrated, the base body 1 is parallelepiped and its longer sides are parallel and inclined with respect to a horizontal plane.

The base body 1, supported by the packaging machine, is inclined with respect to a horizontal plane, because has been found that this is the best arrangement for its operation, also in relation to the surrounding devices, with which the apparatus co-operates.

Moreover, inclined arrangement allows the device conform extremely easily to the essential hygiene norms, since the inclined sides do not facilitate the gathering of dirt and they are easier to clean.

Also the liquids used for cleaning, running on the inclined sides, are eliminated more easily.

Obviously, all this has been described in the following, without any modification of the real arrangement of the base body, with its sides inclined.

In the station A, the numbers and/or symbols identifying the articles, the production lot, possibly series, etc. are applied.

The identifying code is applied by a stationary die 11 and a movable punch 12, through which the blister band 2 is made to pass stepwise.

The blister band 2 is driven by means 81 formed by a recessed roller, motorised by not shown means.

Guiding means 7 for the blister band 2 are situated in the region of the inlet of the station A.

In the station B, longitudinal and/or transversal score lines, allowing to separate small parts of the band, each containing one or more articles, are made on the blister band 2.

These score lines are made by a die 21 and a punch 22 equipped with blades, not shown, between which the blister band 2 is made to pass.

Guiding means 8 for the blister band 2 are situated in the region of the outlet of the station B.

According to the invention, there are adjustment means 110 for automatic change or the longitudinal position of the dies 11, 21, which displace along with the relative punches 12, 22 with respect to the band, movement direction F.

The station C is provided with a die 31 and a severing punch 32.

On the side of the die 31, opposite to the punch, there is an oscillating arm 71 equipped with means for picking up the ready blisters 3 and sending them to a packaging device, not shown, as it is known.

Guiding means 9 for the blister band 2 are situated in the region of the inlet of the station D.

In the off-cuts chopping station D, the longitudinal stripes remaining at the outlet of the cropping station C are shattered.

Also the groups of closed, but not filled blisters, which are not removed from the blister band in the station C, are shattered in the station D.

Possible operation problems can be avoided by adjusting the off-cuts shattering means 40 in relation to the size, so that the shattering operation takes place in the area included between two transversal lines of blisters.

The adjusting operation is carried out by relative adjustment means 120.

All the stations A,B,C,D are equipped with respective actuators 14, 24, 34, 44 for moving the punches 12, 22, 32 and the off-cuts shattering means 40 (FIG. 1).

On its surface turned toward the relative actuator 14, 24, each of the punches 12, 22 features a cavity 22*a*.

As becomes evident from the FIG. 1, a fork 24*b* is introduced into the cavity 22*a*.

The fork 24*b* is fastened to the top of the shaft 24*a* of the respective actuator 24 and engages a cross piece 22*b* fastened to the surface of the punch 22 over the cavity 22*a*.

This allows to connect each punch to the relative actuator by a simple introduction in the direction transversal to the station, movement, which occurs together with installation of the punch, to which the die is connected by suitable guides of known type, as will become clearer from the following description.

The same movement, in the opposite direction, allows to remove the punch, together with the die, from the station, by extracting the cross piece 22*b* from the fork 24*b* and extracting the fork 24*b* from the cavity 22*a*.

According to the invention, the stations A, B, C, D are equipped with clamping means 50, 70 for the numbering devices 10, cutting members 20, severing means 30 and off-cuts shattering means 40.

These clamping means are connected with the releasing motorised means 60, 80, 100 which unlock the numbering devices 10, scoring members 20, severing means 30 and off-cuts shattering means 40, so as to allow the adjustment means 110 and 120 to substitute them and automatically adjust in relation to the size of blister packs to be produced.

The clamping means 50, 70 of the numeral code application station A, the scoring station B and cropping station C include outer stop means 5,125 (FIG. 1) and pressers 53, 54, 55 (FIGS. 9*a*, 9*b*) acting elastically, directly or not directly, as will appear in the following, on the dies 11, 21, 31.

The releasing means 60, 80, 100 prevent the pressers pushing action.

Figure 2:
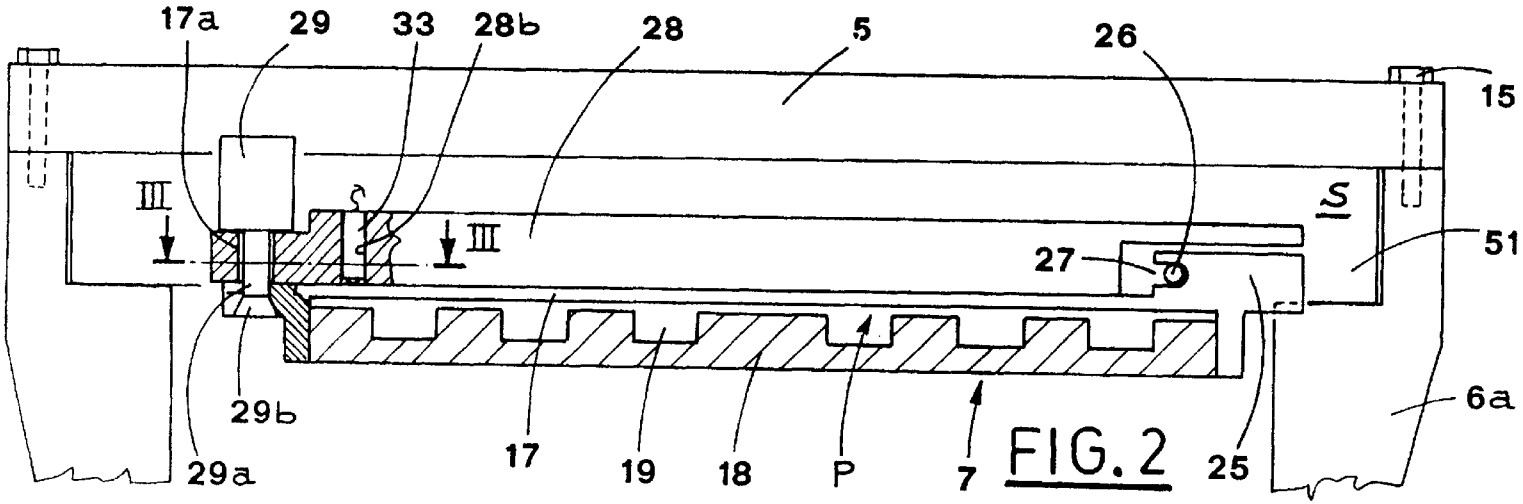
FIG. 2 shows a particular of the apparatus of FIG. 1, along the plane II—II, with some parts in section view.
Figure 4:
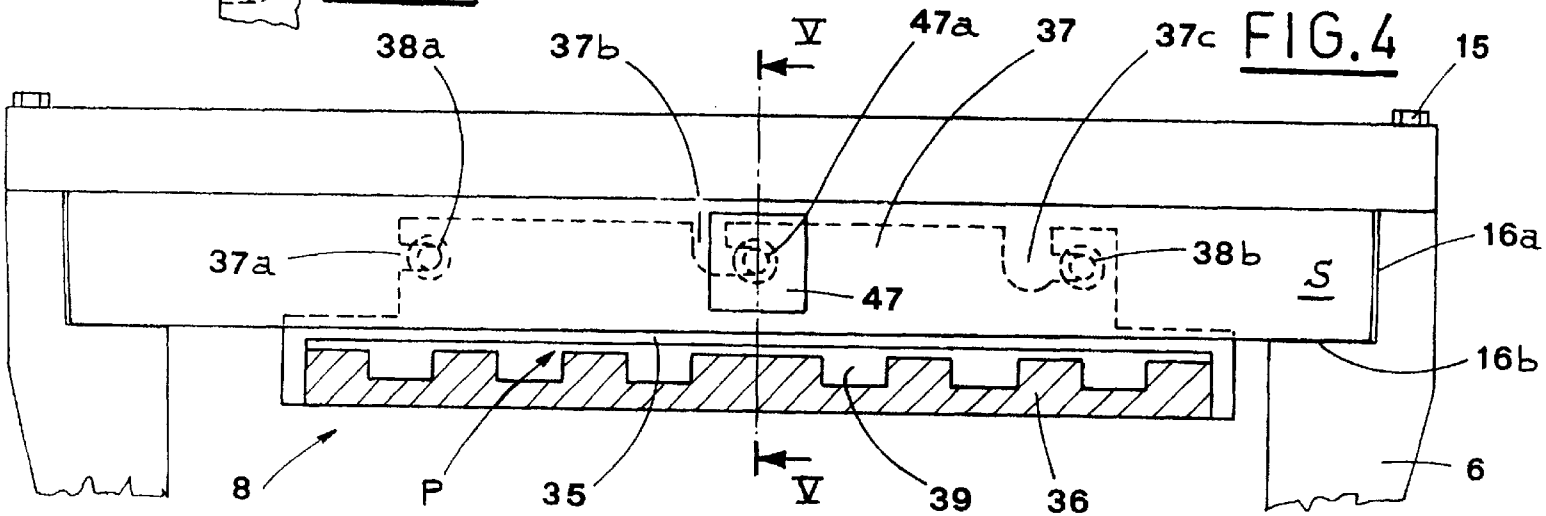
FIG. 4 shows a particular of the apparatus along the plane IV—IV of the FIG. 1, with some parts in section view.
Figure 7:
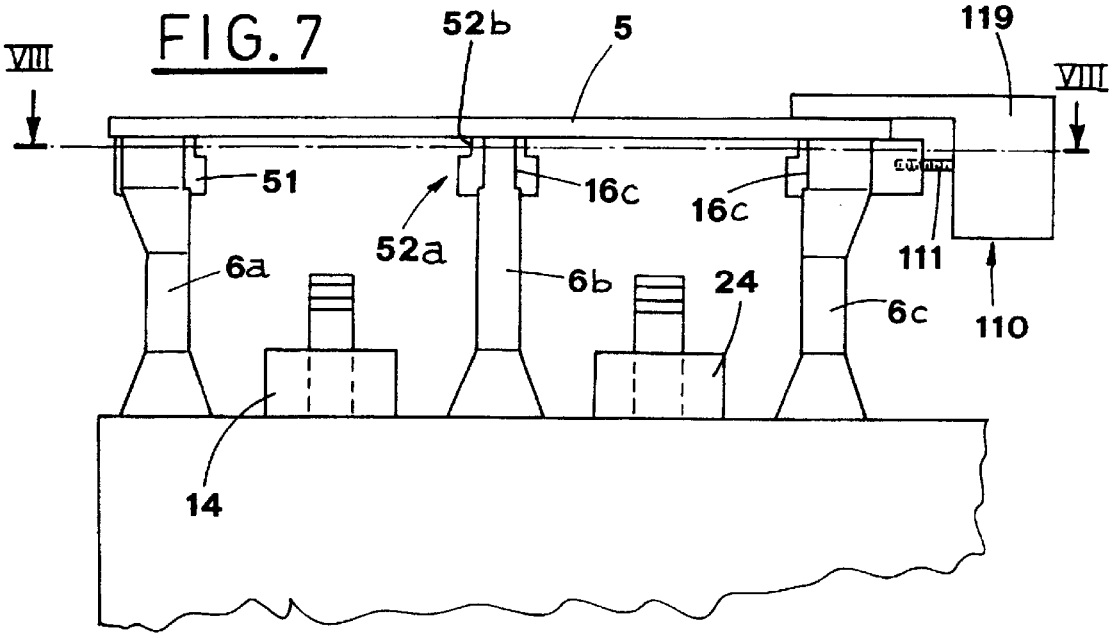
FIGS. 7 and 8 show schematic views, lateral and plan, respectively, of a part of the apparatus without working means acting on the blister band.
Figure 8:
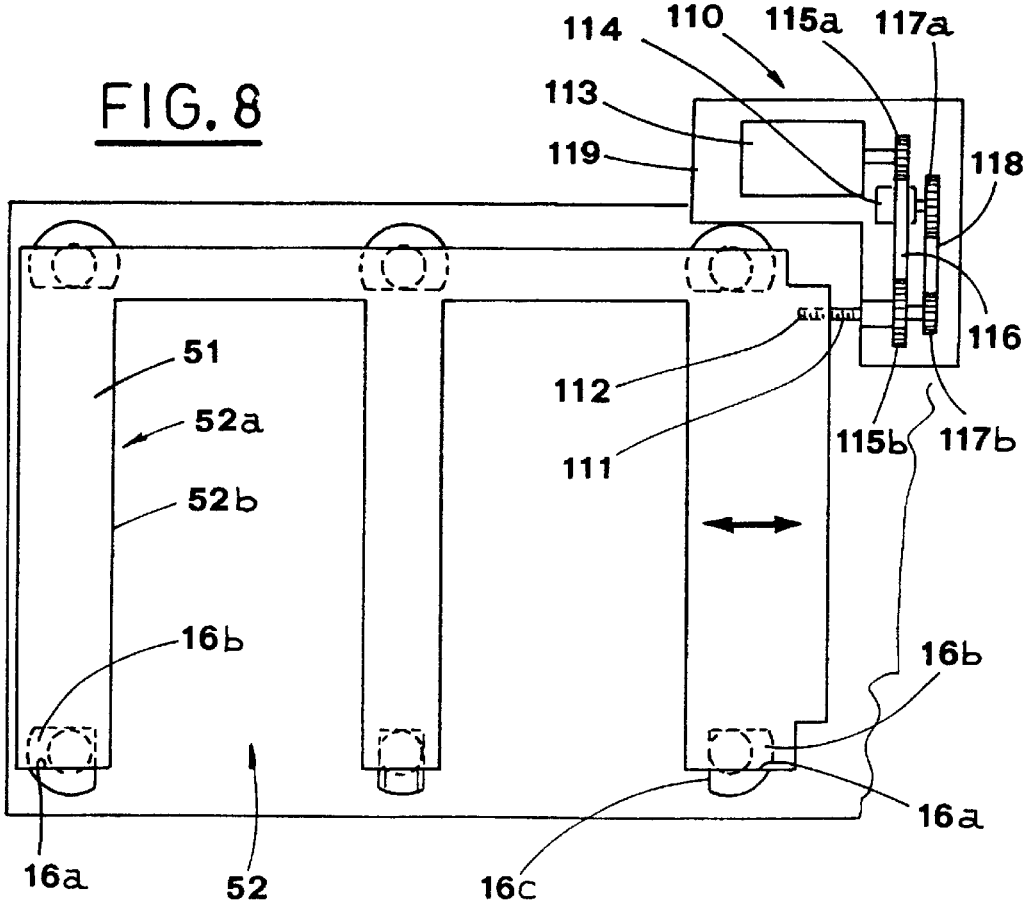

With reference to the FIG. 7 and 8, the outer stop means of the numeral code application station A and the scoring station B include first of all a plate 5 joined, e.g. by a screw 15 seen in the FIGS. 2 and 4, to the top of the spacing bars 6*a*, 6*b*, 6*c* fastened to the base body 1.

Vertical flat regions 16*a* and horizontal flat regions 16*b*, made in the ends of the spacing bars 6*a*, 6*b*, 6*c* joined to the plate 5, delimit respectively the side and the bottom of a housing S defined between this plate 5 and said tops of the bars 6*a*, 6*b*, 6*c* (FIGS. 2, 4, 7 and 8).

A frame 51, slidably introduced into the housing S extending parallel to the blister band 2, features two windows 52 (FIG. 8), open on the side parallel to the longitudinal edge of the blister band 2, which remains turned towards the side opposite to the machine support structure.

The transversal edges of the windows, adjacent to the open side, have a step-like shape.

Figure 9A:
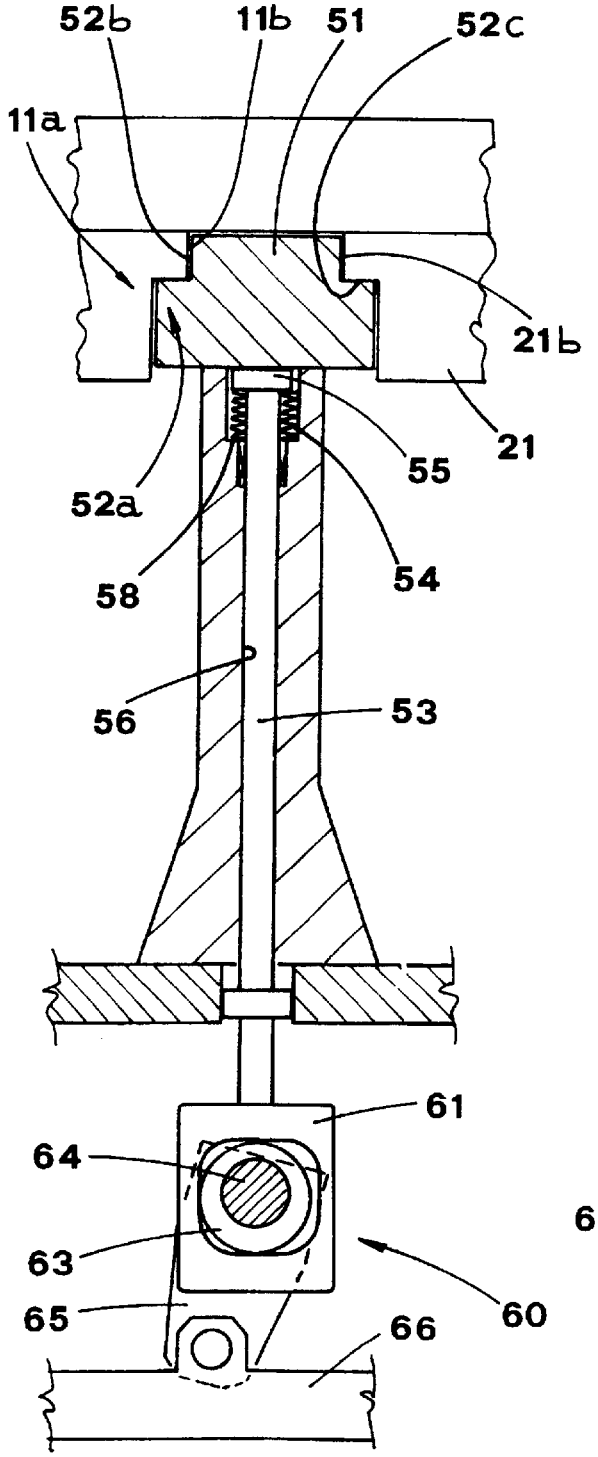
FIGS. 9*a* and 9*b* show a component of the apparatus in two characteristic conditions of its functioning.

In this way plane, prismatic guides are defined for introduction therein of the dies 11,21, whose transversal edges 11*a*, 21*a* are complementary to the edges 52*a* of the windows 52 (FIG. 9*a*).

The sections 52*b* of the edges 52*a* of the windows 52 closer to the plate 5 are thinner than the corresponding sections 11*b*, 21*b* of the edges 11*a*, 21*a* of the dies.

In this way, when the pressers press the frame 51 against the plate 5, the edges 11*b*, 21*b* remain clamped between the edge 52*c* of the frame and the same plate.

The ends of the bars 6*a*, 6*b*, 6*c* joined to the plate, feature vertical passage flat regions 16*c* made in correspondence to the open side of the windows 52, so as to allow the dies to be introduced into said windows.

With reference to the FIGS. 7, 8, 9*a*, 9*b*, 9*c*, the pressers include a shaft 53, slidably introduced into axial through hole 56 made in each of said bars 6*a*, 6*b*, 6*c* and controlled by elastic means 54 formed each by a group of Belleville washers.

The Belleville washers 54 are housed inside a seat 59, with enlarged section, situated at the top of each of the bars 6*a*, 6*b*, 6*c* and act from one side on an enlarged head 55 of the stem, and from the other side resting against a shoulder 58 formed by the bottom of the seat 59 (FIGS. 9*a, b, c*).

Then, the shaft 53 is pushed toward the plate 5, while the opposite end is fastened to the releasing means 60.

The releasing means include a block 61 fastened to the extremity of each shaft 53 opposite to the plate 5.

A cam 63 made on a stem 64 is introduced, with possibility to rotate, into a cavity 62 made in the block 61.

An arm 65 is keyed on the stem 64 and articulated to a bar 66.

Figure 9B:
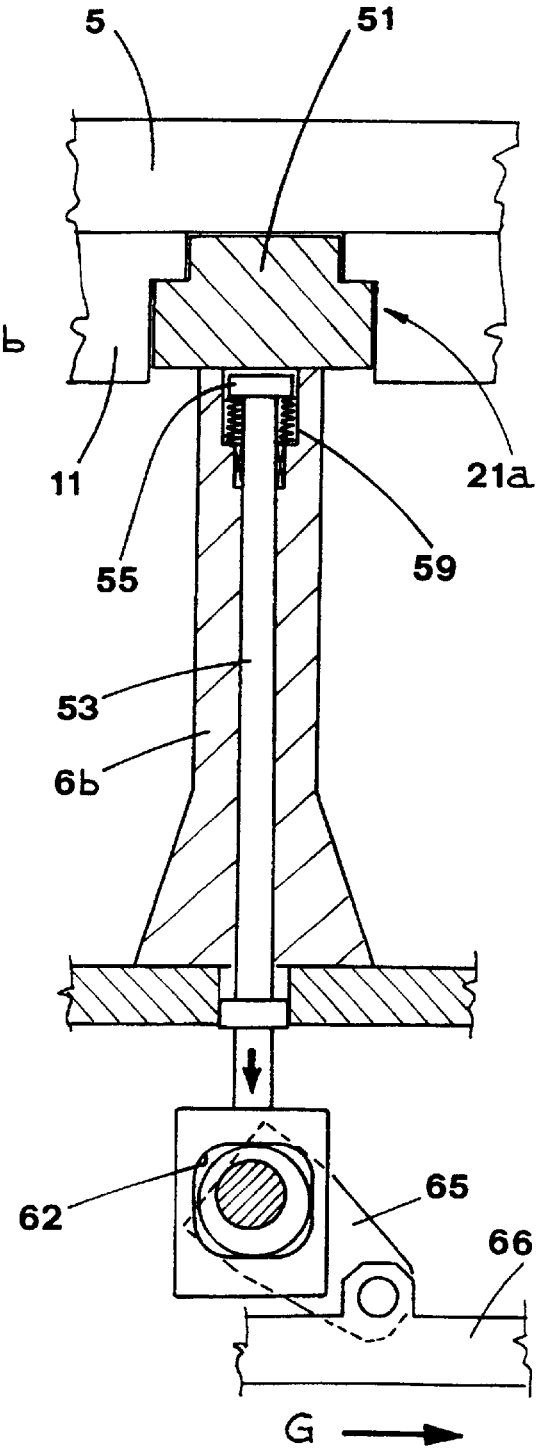

With reference to the FIGS. 9*a* and 9*b*, the longitudinal movement of the bar in the direction G, operated by known and not shown actuators, makes the cam 63 rotate and therefore, causes the head 55 move away from the corresponding run of the frame 51, thus interrupting the clamping action of this frame on the dies 11 and 21.

In this way, it is possible to remove the dies to substitute them, changing the blister pack size, or to adjust the longitudinal position of the frame 51 with respect to the blister band 2.

For the automatic adjustment, the adjustment means 110, fastened to a support case 119 made integral with the plate 5 so as to act on the frame 51, include a threaded shank 111 screwed into a threaded longitudinal hole 112 made in said frame 51 (FIGS. 7 and 8).

A motor 113 is connected with the threaded shank 111, which, on its turn, drives an encoder 114.

In particular, the motor 113 is connected to the threaded shank 111 by toothed pulleys 115*a*, 115*b* respectively keyed onto the shaft of the motor 113 and on the threaded shank 111 and connected to each other by a toothed belt 116.

The encoder 114 is linked to the threaded shank 111 by toothed pulleys 117*a*117*b*, connected to each other by a toothed belt 118.

Figure 15:
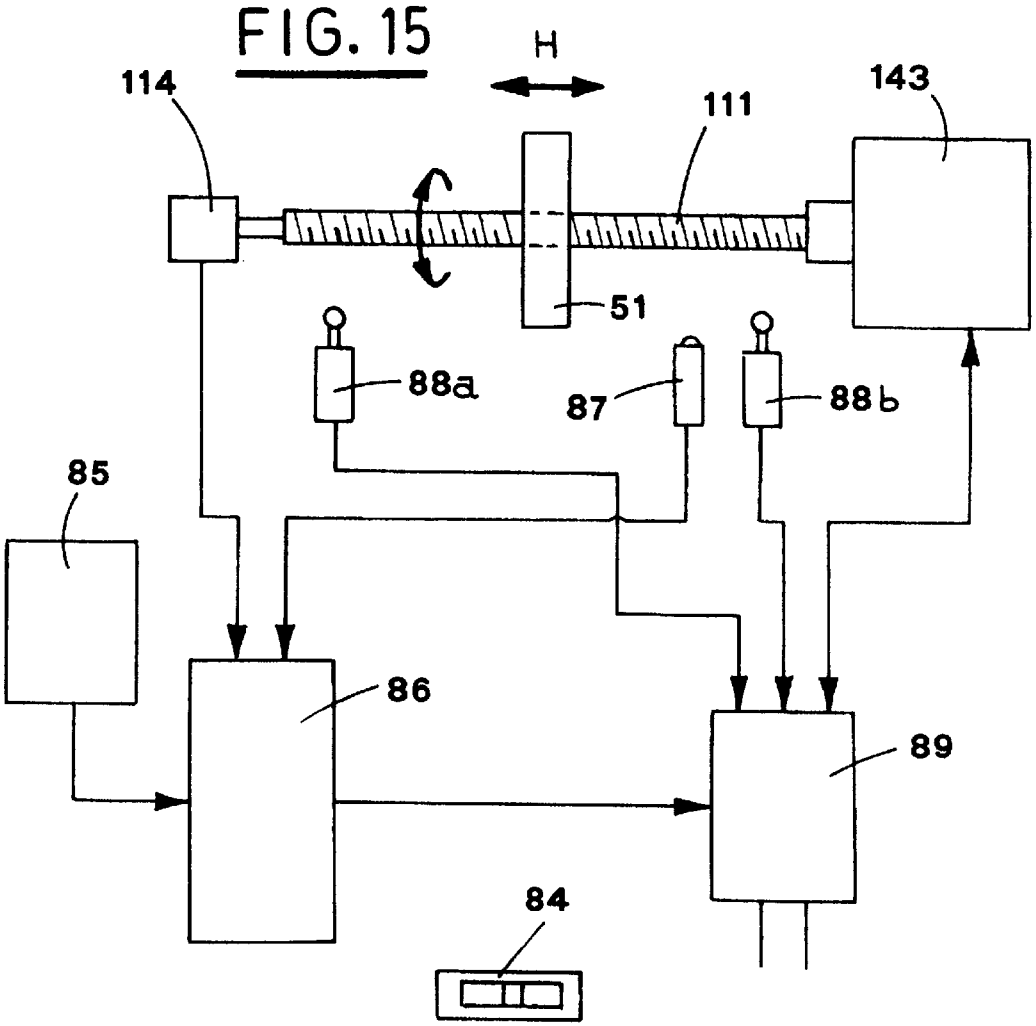
FIG. 15 shows a functional scheme of a control and check system for the adjustment devices mounted on the apparatus, like the ones shown in the FIGS. 7, 8 and 12.

As schematically shown in FIG. 15, the adjustment means 110 are connected to a check and control system, that controls and checks the position of the operative numbering devices 10 and scoring members 20. The check and control system includes a proximity sensor 87, detecting a zero position of the operative means to be adjusted, a signal detector 86 connected to the sensor 87 and to said encoder 114, and a control group 89 connected to the signal detector 86 and to the motor 143.

The whole is joined to a central process unit 85 suitably provided by a corresponding program.

Moreover, the system includes also stop switches 88*a*, 88*b* situated in correspondence to the extreme positions which can be reached by said working means 10,20 being adjusted, and connected to said control group The automatic adjustment is selected with a switch 84 after having unlocked the plate 5, and possibly substituted the dies 11,12 together with the punches 12,22, by operating the motor 143 until the frame 51 reaches the proximity sensor 87 defining the zero position.

In this way, possible errors resulting from inevitable clearances are avoided.

Once the reference index of the central process unit 85 has been cleared, the frame 51 is positioned, on basis of memorized or input data, by detecting and measuring its movement in the direction H, or in the opposite direction, until it reaches the position corresponding to the size of the blister pack to be produced.

The two stop switches 88*a*, 88*b* prevent the moving group from going beyond the limit positions.

After the frame 51 has been positioned, and together with it also the dies and punches, the bar 66 is moved in the direction opposite to the direction G, and the cam 63 of the blocks 61, fastened to the shafts 53, is brought again to the start position, so as to lock again the frame 51 and the dies 11,21.

Figure 3:
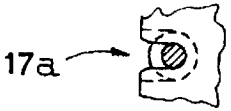
FIG. 3 shows a detail of the particular shown in FIG. 2.

With reference to the FIGS. 2 and 3, the guiding means 7 of the blister band 2 situated at the inlet of the numeral code application station include an upper surface 17, a lower surface 18 and automatic fastening means 25, 26, 27, 28, 29.

The lower surface 18, featuring longitudinal grooves 19, is removably fastened to the upper surface, so as to define therebetween a passage P for the blister band 2.

The upper surface 17 is removably connected to the frame 51, by the fastening means 25, 26, 27, 28, 29 in correspondence to the inlet of the numeral code application station A.

The fastening means include a wall 28 protruding cantilevered from this side of the frame 51 that corresponds to the inlet of the numeral code application station A, and supporting a pin 26 near one longitudinal edge of the frame 51.

The pin 26 is introduced into a receiving seat 27, made in a coupling block 25 connected to the outer face of the upper surface 17.

The seat 27 is parallel to the upper surface 17. A cavity 17*a*, extending parallel to said receiving seat 27, is made on the side of the upper surface 17 opposite to said coupling block 25.

An actuator 29, cantilevered to the wall 28 on the side opposite to the pin 26, acts with its stem 29*a* on the edge of the cavity 17*a*, having a conical profile decreasing toward the protruding wall.

The actuator 29 is formed by a pneumatic cylinder, and the end of its stem 29*a* is shaped so as to have a profile complementary to the profile of the cavity 17*a*.

After having introduced the pin 26 into the seat 27 and the end 29*b* of the shaft 29*a* into the cavity 17*a*, with the horizontal translation movement of the surfaces 17 and 18, the cylinder 29 is activated thus locking the two surfaces against the protruding wall 28.

The operations performed in the opposite order allow to release and possibly substitute the guide means 7, in relation to the size.

A sensor 33 detecting the presence of the blister band 3 in the passage P, is introduced in a hole 28*b* of the protruding wall 28.

Likewise, the guide means (FIG. 4) of the blister band 2 at the outlet of the scoring station B include an upper surface 35, removably connected to the frame 51, a lower surface 36, featuring featuring longitudinal grooves 39 and removably fastened to the upper surface for delimiting therebetween a passage P, and fastening means 37, 38*a*, 38*b*, 47 for removably fastening said upper surface 35 and lower surface 36 to said frame 51.

The guide means 8 are situated in correspondence to the outlet of the scoring station B.

In this configuration, the fastening means include a flat support element 37 extending from the free surface of said upper surface 35 and featuring a plurality of seats 37*a*, 37*b*, 37*c* regularly spaced apart there along. Two pins 38*a*, 38*b*, with one end fastened to the side of said frame 51 corresponding to the outlet of said scoring station B, are introduced into outermost corresponding seats 37*a*, 37*c* thus guiding the flat support element 37.

An actuator 47, formed by a pneumatic cylinder, acts with its stern 47*a* on the flat support element 37, so as to. press it against the corresponding side of said frame 51.

The stem 47*a* has a free end 47*b* of conical section, increasing outwards, which engages with a complementary conical section of the corresponding central seat 37*b* of the element 37.

Figure 5:
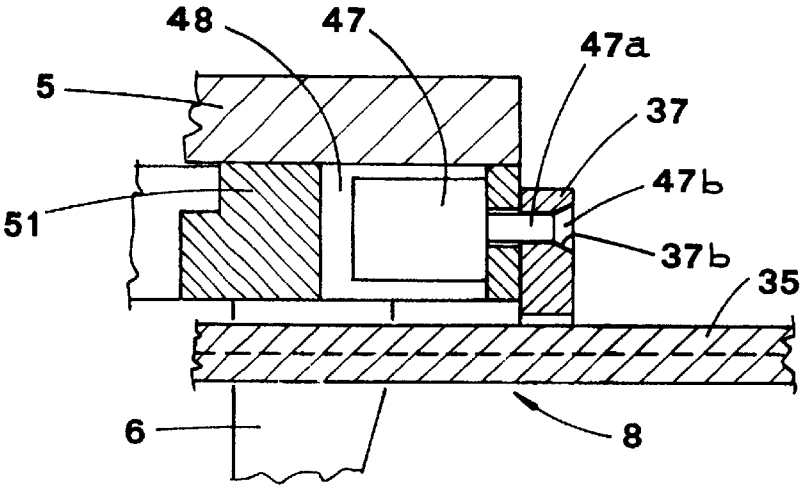
FIG. 5 shows partially the particular of the FIG. 4, along the plane V—V of the FIG. 4, with some parts in section view.

To improve its functionality and reduce its size, the actuator 47 is situated inside a cavity 48 made in the frame 51, from which the stem 47*a* goes out through a through hole (FIG. 5).

Also in this case, after having situated the group composed of the lower surface 35 and upper surface 36 in such a way that the pins 28*a*, 38*b* are introduced into the outermost seats 37*a*, 37*c* and the end 47*b* of the shaft 47 is introduced into the central seat 37*b*, the pneumatic cylinder 47 is activated by a combined upward and then transversal movement towards the machine support structure, thus locking the two guide means 8 against the side of the frame 51 corresponding to the outlet of the station B.

Figure 9C:
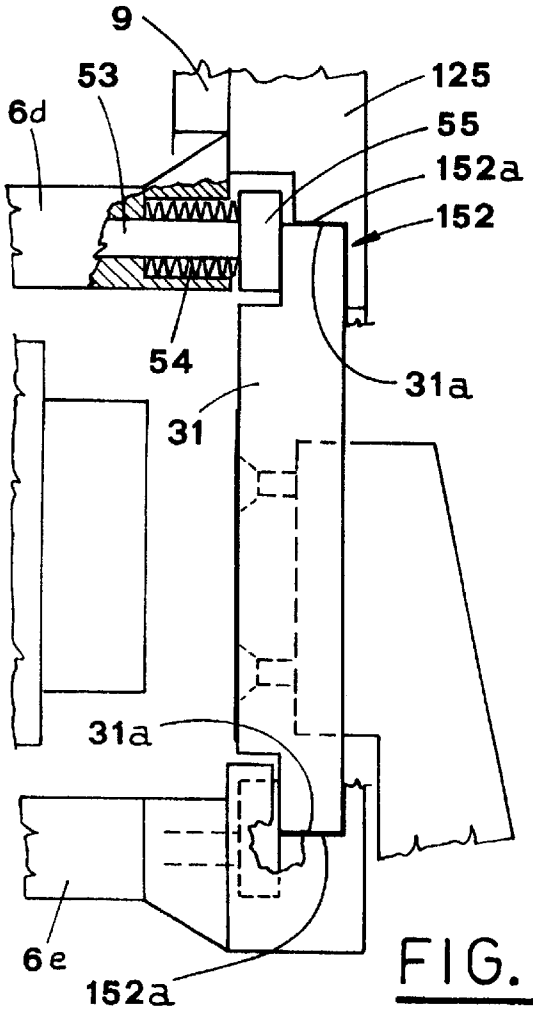
FIG. 9*c* shows a component of the apparatus, similar to the one shown in FIGS. 9*a* and 9*b*, in a version characterised by some variations.

With reference to FIG. 9*c*, the outer stop means of the cropping station C include a plate 125, connected to the top of the spacing bars 6*d*, 6*e*, and defining a window 152 having indented transversal edges 152.

The side of the plate 125 opposite to the machine body is open in correspondence to the window 152, so as to allow the introduction of the die 31 into so defined prismatic plan guides.

The transversal edges 31*a* of the die 31 are directly controlled by the pressers 53,54,55, which also in this case include shafts 53 introduced inside the bars 6*d*, 6*e*, as shown in FIG. 9*c*.

Belleville washers 54, situated on the shafts 53, are connected on the base with the releasing means 80 which are substantially identical with the releasing means 60 described previously.

Suitably, the transversal edges 152*a* of the window 152 are thinner that the corresponding edges 31*a* of the die 31, which results in a simpler construction of the locking system.

Figure 6:
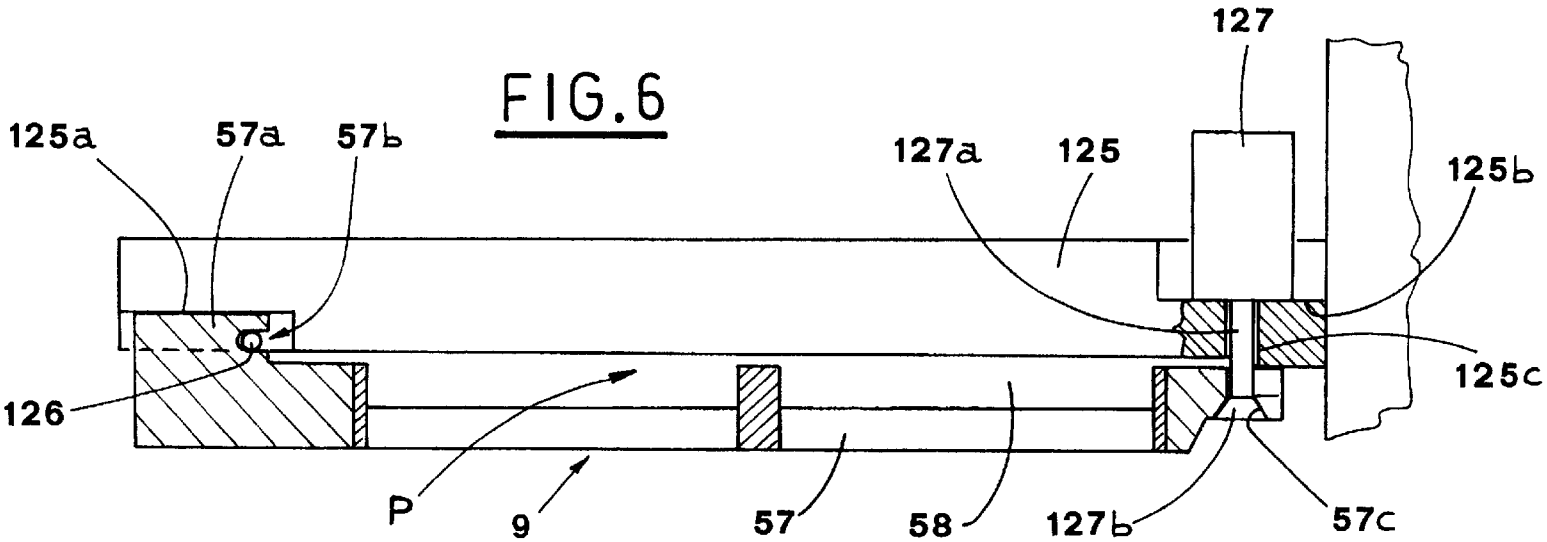
FIG. 6 shows schematic view of a particular of the apparatus along the plane VI—VI of the FIG. 1, with some carts in section view.

With reference to FIG. 6, guide means 9 of the blister band 2, situated at the inlet of the cropping station C are composed of a sliding plate 57, featuring longitudinal grooves 58 and removably fastened to said plate 125 for delimiting therebetween a passage P for the blister band 2, and of fastening means 57*a*, 57*b*, 126, 127 for removably fastening the sliding plate 57 to the plate 125.

The fastening means include a pin 126 supported by the plate 125 in proximity of a longitudinal side and on the head corresponding to the area where the blister band 2 enters the cropping station C, and a protrusion 57*a*, made on the surface of the sliding plate 57 turned toward the plate 125 and featuring a recess 57*b* which extends parallel to the sliding plate 57.

The pin 126 is introduced into the recess 57*b*. Finally, an actuator 127, formed by a pneumatic cylinder, whose stem 127*a* acts on the sliding plate 57, in the region or the side opposite to the protrusion 57*a* for pressing it against the corresponding face of the plate 125.

The stem 127*a* has a free end 127*b* of conical section, increasing outwards, so as to engage with a complementary conical section of a corresponding seat 57*a* made in the sliding plate 57.

To improve its functionality and reduce its size, the pin 1226 is situated inside a housing 125*a* made in the corresponding face of the plate 125, into which it is introduced through a hole made on the head of the plate 125 in correspondence to the housing.

To receive the pin 126 in the recess 57*b*, the protrusion 57*a* of the sliding plate 57, is introduced into the housing 125*a*.

Yet to improve the functionality and reduce the size, the cylinder 127 is situated inside a cavity 125*b* made in the face of the plate 125, opposite to the sliding plate 57, and the shaft 127*a* passes through a hole 125*c* made in the bottom of the cavity 125*b*.

To mount the guide means 9 with a combined movement, beginning from below the inlet of the cropping station C, in the direction of going away from the base 1, and then transversally to the blister band advancement direction, it is necessary to introduce the protrusion 57*a* in the housing 125 and then to introduce the pin 126 into the recess 57*b*, and, contemporaneously, the end 127 of the shaft 127*a* of the cylinder 127 into the complementary seat 57*c*.

At this point, the pneumatic cylinder 127 is activated and the sliding plate 57 is locked to the plate 125.

Figure 11:
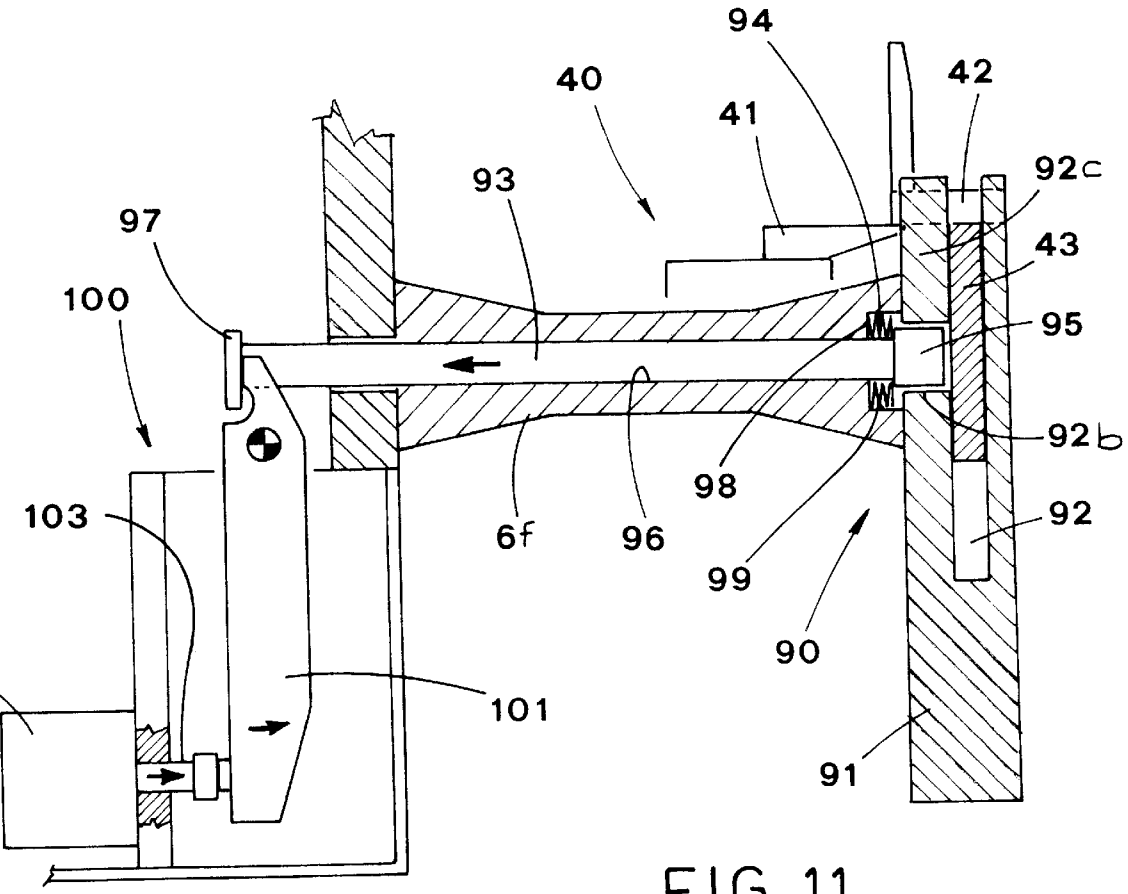
FIG. 11 shows a schematic section view of another particular of the subject apparatus, corresponding to an additional station of the apparatus.
Figure 10:
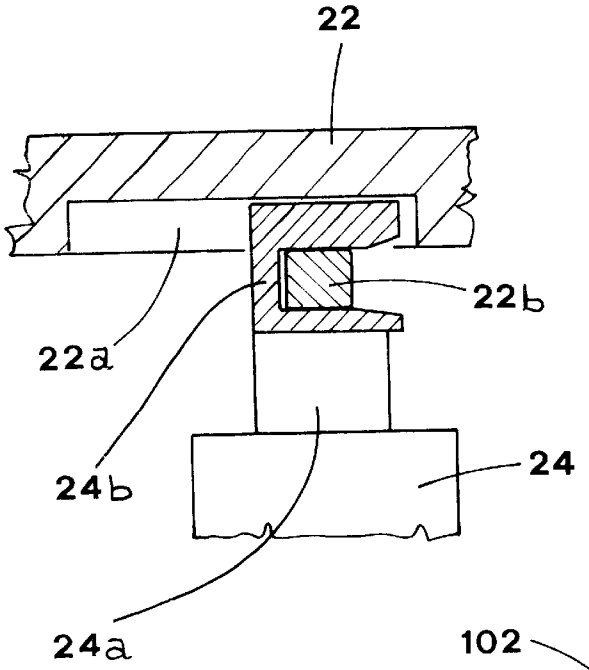
FIG. 10 shows a particular type of connection between the working means acting on the blister band and relative actuators.

As has been already said, also the station D of the remaining off-cuts reclaiming, in which shattering means 40 cut the off-cuts by a moveable blade 41 and a stationary counter blade 42, is equipped with automatic clamping means 90, shover In FIG. 11.

These clamping means include stop means 91, substantially formed by a plate 91 slidably guiding a plate 43, which supports the stationary counter blade 42.

The plate 91 is connected to the spacing bars 6*f* fastened to the body 1, and features a window 92 with longitudinal U-grooved edges 92*a*, so as to define prismatic plan guides for introduction of the support plate 43.

Also in this case there are pressers 93, 94, 95 acting elastically on the support plate 43, so as to press it against the edges of the window of the plate 91 through holes 92*b* made on the walls 92*c* situated along the edges 92*a* of the window 92 and turned toward these pressers.

Also the pressers of the station D, shown in FIG. 11, include stems 93, slidably introduced inside respective axial through holes 96 made in the bars 6*f*.

Each of the stems 93 is controlled by elastic means 94, which push it toward the stop means 91, and whose end opposite to the stop means is fastened to the unlocking means 100, likewise the pressers of other stations.

In particular, the stem 93 features an enlarged head 95, below which there are situated Belleville washers 94 resting on a shoulder 98.

The shoulder 98 is obtained in the hole 96 by a section widening 99 situated a the top of each of the bars 6*f* and containing said head 95 and said Belleville washers 94.

The unlocking means 100 of the station D are different from the unlocking means of other stations A, B and C.

In fact, they include, for each stem 93, a rocker arm 101 hinged to the body 1 and whose one end acts on a disc 97, which is integral with the end of said stem 93 opposite to the relative head 95.

An actuator 102, including a pneumatic cylinder, pushes with the relative stem 103 on the other end of the rocker arm 101, driving the latter to oscillate, moving the stem away from the plate 91, and releasing the support plate 43 of the stationary counter blade.

Figure 12:
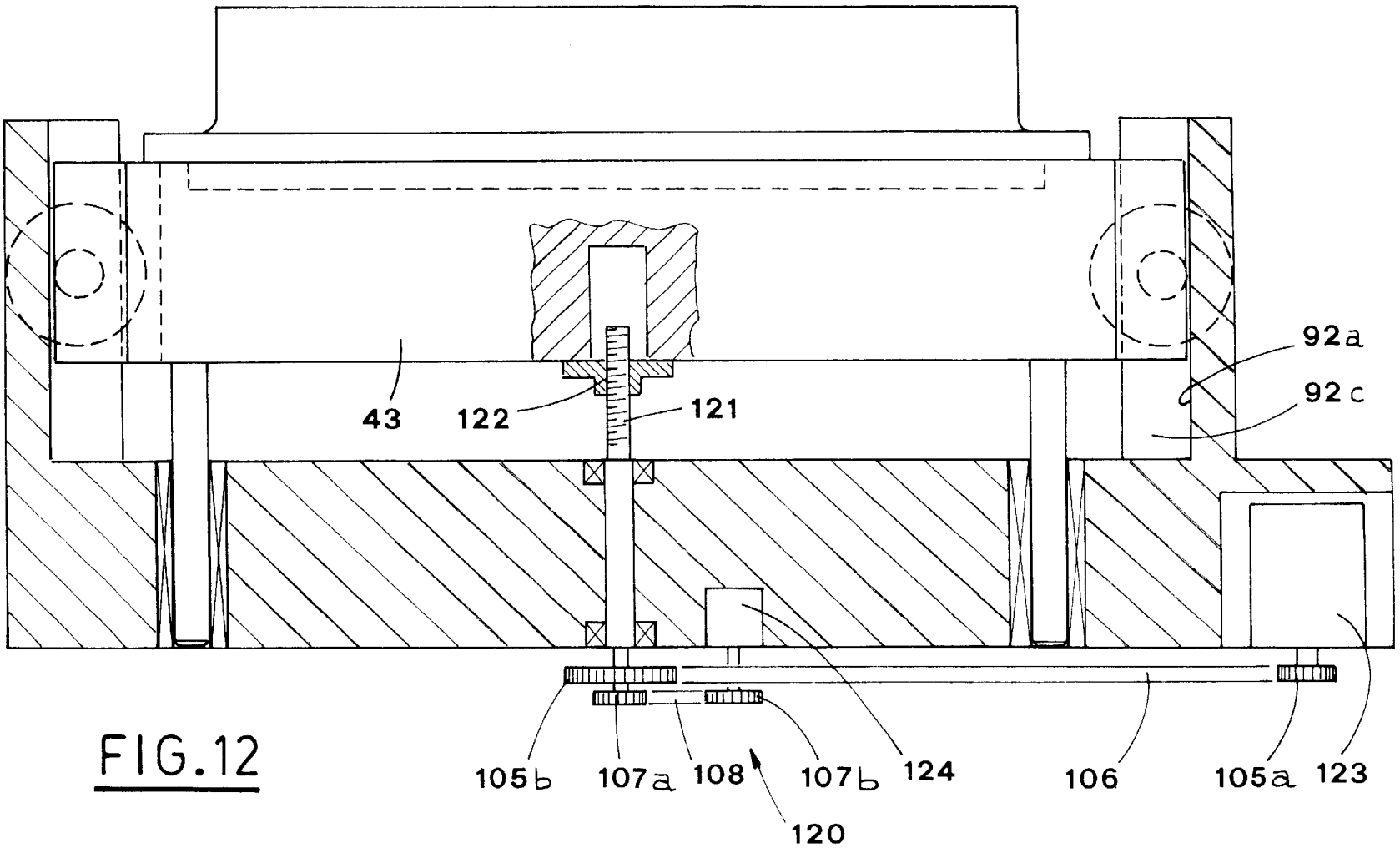

The support plate 43 is moved by adjustment means 120, shown in FIG. 12, which include a threaded shaft 121 screwed into a threaded hole 122 made in this support plate 43 and parallel to the longitudinal extension of the blister band.

The threaded shaft 121 is connected to a motor 123 and to rotation detecting means 124 formed by an encoder 124.

The motor 123 is connected with the threaded shaft by toothed pulleys 105*a*, 105*b* respectively keyed to the shaft of the motor 123 and to the threaded shaft 121, and linked to each other by a toothed belt 106.

Also the threaded shaft 121 is connected to the encoder 124 by toothed pulleys 107*a* and 107*b*, connected to each other by a toothed belt 108.

Besides the counter blade 42, the support plate 43 carries also guide means 45, of known type, along which a blade holder 46 slides, with the movable blade 41 mounted thereon.

The blade holder 46 is connected to operation means 44 formed by a connecting rod 44*a*—crank 44*b* assembly, joined to a rotating body 144 (FIG. 13), which is operated in time relation with the band advancement movement by not shown operating means.

As has been already said, there is a motorised recessed driving roller 81 of the blister band 2, while in correspondence to the cropping station C there is an oscillating arm 71.

These means are supported by respective pins 82, and are kept in the respective working positions by locking/unlocking means 72, shown in FIG. 14.

The locking/unlocking means 72 include a bar 74 supported rotatingly, with possibility to slide axially and parallel to the respective pin 82, by a support structure 4.

A holding segment 73 fastened in radial direction to the end of said bar 74 corresponding to the free end of said pin 82, carries a protrusion with a conical head 73*a* fastened to the free end of the segment and turned toward the pin 82.

Two pneumatic cylinders 75, 76 act on the bar 74, so as to drive it to swing and move longitudinally.

In particular, the pneumatic cylinders 75, 76 are connected to the bar 74 by respectively, a rocker arm 77 hinged to the support structure 4, and a crank 78 fastened in radial direction to this bar 74.

Operated in a suitable sequence, the two cylinders 75, 76 determine first the axial translatic of the bar 74, moving the pointed protrusion 73*a* away from the pin 8 and releasing the roller 81, or respectively, the oscillating arm 71.

The cylinder 75, by dragging the rocker arm 77, moves the bar 74 outwards.

Then, the cylinder 76, only the shaft of which is shown in the figure, acts on the crank 78 causing the rotation of the holding segment 73, thus allowing to extract and substitute the roller 81, and respectively, the oscillating arm 71.

It is obvious how all the objects mentioned in the introductory notes have been obtained with the apparatus being the subject of the present invention.

In particular, the assembling of the locking systems operated by pneumatic means allows, by suitably arranged pushing means controlled by a suitable control unit, to automatically lock or unlock, selectively or globally, working means previously described.

With reference to the described arid illustrated example embodiment, when it is necessary to change the size of the blister packs to be produced, only one command determines unlocking the dies 11, 21, 31 in the stations A, B, C and the cutting means 40 in the station D, release of the guide means 7, 8, 9 and oscillation of the holding segments 73 of the roller 81 and the oscillating arm 71.

Therefore, the operator substitutes only the numbering and cutting means by removing the dies 11, 21 together with the relative punches 12, 22, introducing then the working means corresponding to the new size.

Afterwards, the adjustment means operate, so as to adjust the position of the substituted means, as well as of the shearing means 40, on the base of the arrangement of the blisters on the blister band of the new size.

The roller 81 and the oscillating arm 71 are removed from the relative supporting pins 82 and substituted with the ones suitable for the new size.

Finally, one command determines locking of these working means, and the apparatus is ready for restoring the operating condition.

All these substitution operations are performed in very short periods of time, which is possible due to the fact that the apparatus is arranged to unlock and lock working means by pneumatic actuators which work practically instantaneously.

The operator does not have to work for hours to release the means to be changed and to tighten them again after having adjusted their position. He must only substitute the parts with the ones corresponding to the new size.

Since the adjustment of the working means positions is controlled by electronic means, it is possible to memorise and subsequently recall parameters related to the different dies, which can be performed manually or automatically, as it is known to the experts of the sector.

What is claimed is:

1. An apparatus for printing, scoring and cropping blister packs obtained from a blister band, and for chopping remaining off-cuts, the apparatus being mounted on an automatic machine for packaging articles into blister packs, said machine comprising:

a numeral code application station, in which a numeric code is applied to the blister band by at least one numbering device operated by first actuators and having first guide means for the blister band;

a scoring station, having scoring means operated by second actuators, and having second guide means for the blister band; driving means for the blister band;

a cropping station, having severing means operated by third actuators and having third guide means for the blister band, an oscillating arm provided with pick up means for picking up completed blister packs and sending them to a packaging device;

an off-cuts chopping station, in which remaining off-cuts of the blister band are chopped;

a base body for supporting the stations;

first clamping means situated in said numeral code application station for clamping said numbering device, second clamping means situated in said scoring station for clamping said scoring means, third clamping means situated in said cropping station for clamping said severing means; and motorized releasing means acting on said first, second and third clamping means as to release said numbering device, scoring means and severing means to allow substitution and automatic adjustment thereof by adjustment means in relation to the size of the blister packs;

each of said first, second and third clamping means having outer stop means for dies forming said numbering device, scoring means and severing means, said outer stop means being carried by spacing bars fastened to the base body, and having pressers acting elastically on said dies of said numbering device, scoring means and severing means, so as to clamp the dies against said outer stop means, said pressers being controlled by said motorized releasing means such that the pressing action of the pressers is interrupted.

2. An apparatus, according to claim 1, wherein said outer stop means for said numeral code application station and said scoring station include at least one stop plate, connected to tops of said spacing bars, at least one frame slidably introduced into at least one corresponding housing defined between the tops of said spacing bars and said at least one stop plate;

said at least one frame having at least one window having indented transversal edges and being open in one side, so as to define prismatic flat guides for introduction of at least one of said dies, having transversal edges complementary to the edges of said at least one windows;

the edges of said at least one window nearer to said plate being narrower than corresponding edges of said dies.

3. An apparatus, according to claim 2, wherein the tops of said spacing bars connected to said at least one stop plate have vertical flat regions and horizontal flat regions that delimit respectively the side and the bottom of said corresponding housing.

4. An apparatus, according to claim 2, wherein the tops of said spacing bars connected to said at least one stop plate feature vertical passage flat regions made in correspondence to an open side of said at least one window, so as to allow each of said dies to pass through said open side.

5. An apparatus, according to claim 2, wherein the tops of said spacing bars are connected to said at least one stop plate by means of a screw.

6. An apparatus, according to claim 2, further comprising adjustment means acting on said frame and having:

a threaded shank screwed in an elongated threaded hole made in said at least one frame;

a motor connected with said threaded shank; and, means for detecting rotation of said threaded shank.

7. An apparatus, according to claim 6, wherein said motor is connected to said threaded shank by toothed pulleys respectively keyed onto a shaft of said motor and on said threaded shank, the toothed pulleys linked by a toothed belt.

8. An apparatus, according to claim 6, wherein said threaded shank is connected to said detecting means by a toothed pulley keyed on said threaded shank, and by a toothed pulley connected to said detecting means, said toothed pulleys linked by a toothed belt.

9. An apparatus, according to claim 6, wherein said detecting means include an encoder.

10. An apparatus, according to claim 6, wherein said threaded shank, motor and detecting means are fastened to a support case made integral with said at least one stop plate.

11. An apparatus, according to claim 2, wherein said numeral code application station has an inlet area, said first guide means being situated at the inlet area, said first guide means comprising:

an upper surface removably fastened to said at least one frame;

a lower surface having longitudinal grooves and being removably fastened to said upper surface for delimiting therebetween a passage for the blister band;

fastening means for removably fastening said upper surface and said lower surface to said frame.

12. An apparatus, according to claim 11, wherein said fastening means include:

a wall connected to a side of said at least one frame corresponding to said inlet area;

a coupling block connected to an outer face of said upper surface along a longitudinal edge thereof;

a pin supported by said wall near the longitudinal edge of said at least one frame;

a receiving seat made in said coupling block and extending parallel to said upper surface, for receiving said pin;

a cavity made on the said upper surface opposite to said coupling block and extending parallel to said receiving seat;

a fourth actuator, fastened to said wall on a side opposite to said pin and having a stem acting on an edge of said cavity.

13. An apparatus, according to claim 12, wherein said fourth actuator is a pneumatic cylinder.

14. An apparatus, according to claim 12, wherein a profile of said cavity is conically decreasing toward said wall and a profile of an extremity of said stem is complementary thereto.

15. An apparatus, according to claim 12, wherein said wall supports a sensor for detecting a presence of the blister band.

16. An apparatus, according to claim 2, wherein said scoring station has an outlet area, said second guide means being situated at the outlet area, said second guide means comprising:

an upper surface removably fastened to said at least one frame;

a lower surface, having longitudinal grooves and being removably fastened to said upper surface for delimiting therebetween a passage for the blister band;

fastening means for removably fastening said upper surface and said lower surface to said frame.

17. An apparatus, according to claim 16, wherein said fastening means include:

a flat support element extending from a free surface of said upper surface and having a plurality of seats;

at least one pin introduced into a corresponding seat, one end being fastened to said at least one frame;

at least one fifth actuator having a stem acting on said flat support element so as to press the flat support element against the side of said at least one frame.

18. An apparatus, according to claim 17, wherein said at least one fifth actuator has a pneumatic cylinder and a stem having a free end with an outwardly increasing conical profile, so as to engage a complementary conical profile of a corresponding seat.

19. An apparatus, according to claim 17, wherein said at least one fifth actuator is situated inside a cavity made in said frame from which the stem extends and passes through a through hole.

20. An apparatus, according to claim 2, wherein said cropping station has a cropping station inlet area, said third guide means being situated at the inlet area, said third guide means comprising:

a sliding plate having longitudinal grooves and being removably fastened to the at least one stop plate for delimiting therebetween a passage for the blister band;

fastening means for fastening removably said sliding plate to the at least one stop plate.

21. An apparatus, according to claim 20, wherein said fastening means include:

a pin supported by the at least one stop plate in proximity of a longitudinal side thereof corresponding to the inlet area where said blister band enters said cropping station;

a protrusion made on a surface of said sliding plate facing toward the at least one plate and having a recess which extends parallel to said sliding plate and inside of which said pin is introduced;

at least one sixth actuator having a stem acting on said sliding plate, on a side opposite to said protrusion for pressing the sliding plate against a corresponding face of the at least one stop plate.

22. An apparatus, according to claim 21, wherein said at least one sixth actuator includes a pneumatic cylinder having a stem with an outwardly increasing conical profile end engaged with a complementary conical profile seat.

23. An apparatus, according to claim 21, wherein said pin is introduced into a housing formed in the at least one stop plate, and into which said protrusion of said sliding plate is introduced.

24. An apparatus, according to claim 21, wherein said at least one sixth actuator is situated inside a cavity made in a surface of the at least one stop plate, opposite to said sliding plate, and said stem is moved through a hole made in the bottom of said cavity.

25. An apparatus, according to claim 2, wherein said numbering device and scoring means are formed by respective groups, each group including a die, introduced inside a respective window of said at least one frame, and a punch, engaged with an end of the respective first and second actuators carried by said base body.

26. An apparatus, according to claim 25, wherein each of said punches has a cavity, a fork introduced into the cavity, said fork being fastened to a top of a shaft of said second actuator and engaged to a cross piece fastened to a surface of said punch over said cavity.

27. An apparatus, according to claim 2, wherein said at least one frame includes two windows respectively for the dies forming said numbering device and scoring means.

28. An apparatus, according to claim 1, wherein each of said pressers includes a shaft having a first extremity slidingly introduced into an axial through hole made in each of said spacing bars, said shaft being controlled by elastic means that bias the shaft toward said outer stop means, a second extremity of said shaft, opposite to said stop means, fastened to said motorized releasing means.

29. An apparatus, according to claim 28, wherein for each shaft said releasing means include:

a block fastened to the second extremity of said shaft opposite to said outer stop means;

a cavity made in said block;

a rotatable cam made on a stem and introduced inside said cavity;

an arm keyed to said stem and hinged to a bar.

30. An apparatus, according to claim 28, wherein each shaft has an enlarged head below which there are situated Belleville washers acting on a shoulder made in said hole situated at the top of each of said spacing bars, for containing said head and said Belleville washers.

31. An apparatus, according to claim 1, wherein said outer stop means for said cropping station include at least one plate, connected to a top of said spacing bars, defining at least one window having indented transversal edges and being open in correspondence to said at least one window, the indented transversal edges defining prismatic plan guides for introduction of a cropping die having transversal edges which are to be clamped by said pressers.

32. An apparatus, according to claim 31, wherein said indented transversal edges of said at least one window are narrower than the corresponding transversal edges of said cropping die.

33. An apparatus, according to claim 1, wherein said driving means of the blister band, formed by a motorized recessed driving roller, and said oscillating arm, supported by respective pins, are kept in respective working positions by locking/unlocking means, which comprise:

an axially slidable bar rotatably supported parallel to a related pin by a support structure;

a holding segment arranged in a radial direction relative to an end of said bar and to a free end of one of said respective pins;

a protrusion with a conical head fastened to said holding segment and facing one of said respective pins;

a seventh actuator and an eighth actuator acting on said bar, so as to drive the bar to swing and move longitudinally.

34. An apparatus, according to claim 33, wherein said seventh and eighth actuators are formed by pneumatic cylinders acting on said bar by, respectively, a rocker arm hinged to said support structure, and a crank fastened to the bar and arranged in radial direction relative to said bar.

35. An apparatus, according to claim 1, wherein said cropping station for chopping remaining off-cuts of blister band comprises:

shattering means having a movable blade and a stationary counter blade for cutting the off-cuts;

cropping station clamping means including stop means for a plate supporting said stationary counter blade, and being carried by spacing bars fastened to said body;

pressers acting elastically on said support plate, so as to press the support plate against said outer stop means;

unlocking means which act on said pressers to interrupt their pressing action.

36. An apparatus, according to claim 35, wherein said outer stop means of said off-cuts chopping station has a plate joined to the top of said spacing bars and defining a window having longitudinal U-grooved edges, forming prismatic flat guides for introduction of said support plate, through holes made in the walls of the edges turned toward said pressers so as to allow the pressers to act on said support plate.

37. An apparatus, according to claim 35, wherein said pressers include a stem, having one end slidingly introduced into an axial through hole made in each of said spacing bars, said stem being controlled by elastic means which bias the stem toward said stop means, an end of said stem opposite to said stop means fastened to said unlocking means.

38. An apparatus, according to claim 37, wherein said support plate carries guide means, along which a blade holder slides, said movable blade mounted on said blade holder and connected to alternative operation means, said apparatus further including adjustment means acting on said support plate to adjust the longitudinal position of said stationary counter blade and movable blade with respect to the at least one stop plate.

39. An apparatus, according to claim 38, wherein said adjustment means comprise:

a threaded shaft screwed into a threaded hole made in said support plate parallel to a longitudinal extension of the blister band;

a motor connected to said threaded shaft;

detector means for detecting rotation of said threaded shaft.

40. An apparatus, according to claim 39, wherein said motor is connected to said threaded shaft by toothed pulleys, respectively keyed to a shaft of said motor and to said threaded shaft, the toothed pulleys linked by a toothed belt.

41. An apparatus, according to claim 39, wherein said threaded shaft is connected to said detecting means by a toothed pulley keyed to said threaded shaft and a toothed pulley connected to said detector means, said toothed pulleys linked by a toothed belt.

42. An apparatus, according to claim 39, wherein said detector means include an encoder.

43. An apparatus, according to claim 37, wherein each of the stems has an enlarged head, below which there are situated Belleville washers acting on a shoulder of said hole situated at the top of each of said bars, the shoulder containing said head and said Belleville washers.

44. An apparatus, according to claim 43, wherein said unlocking means comprise:

a rocker arm hinged to said body and having a first end acting on a disc, which is integral to an end of said stem opposite to the enlarged head;

a ninth actuator having a stem which acts on a second end of said rocker arm.

45. An apparatus, according to claim 1, wherein said adjustment means are connected to a control and check system for determining and verifying the position of said numbering device and scoring means, said control and check system comprising:

a proximity sensor, which detects a zero position of the operative means to be adjusted;

an encoder linked to a rotating member which moves the numbering device and scoring means;

a signal detector connected to said sensor and to said encoder;

a control group connected to said signal detector and to the motor.

46. An apparatus, according to claim 45, wherein said control and check system has two stop switches situated in regions of extreme positions of said numbering device and scoring means being adjusted, said stop switches being connected to said control group.

* * * * *